US007165475B2

(12) United States Patent
Teppe

(10) Patent No.: US 7,165,475 B2
(45) Date of Patent: Jan. 23, 2007

(54) BOTTLE OPENER

(76) Inventor: Bruno Teppe, 6, allée des Granges, F-01440 Viriat (FR)

( * ) Notice: Subject to any disclaimer, the term of this patent is extended or adjusted under 35 U.S.C. 154(b) by 195 days.

(21) Appl. No.: 10/276,296

(22) PCT Filed: Apr. 13, 2001

(86) PCT No.: PCT/FR01/01142

§ 371 (c)(1),
(2), (4) Date: Nov. 22, 2002

(87) PCT Pub. No.: WO01/89982

PCT Pub. Date: Nov. 29, 2001

(65) Prior Publication Data

US 2003/0159545 A1 Aug. 28, 2003

(30) Foreign Application Priority Data

May 22, 2000 (FR) ..... 00 06497

(51) Int. Cl.
*B67B 7/014* (2006.01)

(52) U.S. Cl. ..... 81/3.55; 81/3.41; D8/40

(58) Field of Classification Search ..... 81/3.09, 81/3.41, 3.55, 3.57, 177.3; D8/18, 40, 38
See application file for complete search history.

(56) References Cited

U.S. PATENT DOCUMENTS

| | | | | | |
|---|---|---|---|---|---|
| 888,580 | A | * | 5/1908 | Brinn | 81/3.41 |
| 983,454 | A | * | 2/1911 | Ludwig | 30/123.5 |
| 1,578,627 | A | | 3/1926 | Baumgarten | |
| 2,548,517 | A | * | 4/1951 | Clark | 81/3.57 |
| D163,422 | S | * | 5/1951 | Runkle et al. | D8/18 |
| 3,495,284 | A | * | 2/1970 | Weingardt | 81/3.55 |
| 4,805,238 | A | * | 2/1989 | Crafts | 2/20 |
| 5,133,233 | A | | 7/1992 | Erwin | |
| 5,261,299 | A | | 11/1993 | Kondos | |
| 5,276,922 | A | * | 1/1994 | Floyd, Jr. | 2/160 |

FOREIGN PATENT DOCUMENTS

| | | |
|---|---|---|
| DE | 19640660 | 4/1998 |
| FR | 2216216 | 8/1974 |
| FR | 2707278 | 1/1995 |

* cited by examiner

*Primary Examiner*—Hadi Shakeri
(74) *Attorney, Agent, or Firm*—Greenblum & Bernstein, P.L.C.

(57) ABSTRACT

The invention also provides for a bottle opener that includes a finger engaging portion adapted to at least partially surround at least one finger. A handle portion is fixed to the finger engaging portion. The handle portion includes an opening head. The opening head includes a central opening. The central opening is defined by a bearing edge, a catching edge and two lateral sides. The handle portion has a surface that engages a user's palm when the bottle opener is used to open a bottle. This Abstract is not intended to define the invention disclosed in the specification, nor intended to limit the scope of the invention in any way.

4 Claims, 3 Drawing Sheets

BOTTLE OPENER

CROSS-REFERENCE TO RELATED APPLICATIONS

The present application is a National Stage Application of International Application No. PCT/FR01/01142, filed Apr. 13, 2001. Further, the present application claims priority of French Patent Application No. 00/06497 filed on May 22, 2000.

BACKGROUND OF THE INVENTION

1. Field of the Invention

The invention relates to a bottle opening device. The bottle opening device can be a crown cork opener and can be positioned onto the fingers of the hand.

2. Discussion of Background Information

Crown corks are intended to act as stoppers for the necks of bottles. The rims of the bottles have a retainer of semitoric shape or a screw thread having at least one undercut. Crown corks consist mainly of a metal disk placed on the neck concentric therewith, the edges of which are knocked down laterally to crimp it onto the retainer, thus forming a crinkle band. A great many crown cork openers exist. These devices generally comprise a handle extended by an opening head and comprise two devices. One device is an opening head which bears on the upper part of the cap. Another device is used for catching under at least one crinkle of the crinkle band. When the bottle opener is in position on the crown cork, opening is achieved either by raising the handle if the catching device is situated between the handle and the bearing device, or by lowering the handle if the bearing device is between the handle and the catching device.

Patent FR-A-2,707,278 describes a bottle opener that additionally comprises a device for fitting the latter onto a finger of the hand. This adapter device forms, with the opening head, a ring which, when slipped onto a finger, allows the bottle opener to be secured to the hand. Under these conditions, the handle of the bottle opener lies in the palm of the hand and bottle opening is achieved by leaning on the handle with the palm of the hand. This adapter device is connected to the bottle opener in a region lying between the bearing device and the catching device which lie at the level of the first finger bone in the region where the finger bones are well differentiated. A device such as this has the disadvantage of being relatively bulky and of hampering the user in his other activities such as, for example, handling coins or shaking hands with someone else. What happens is that the additional thickness of the opening head situated under the finger bone and the handle prevents certain objects from being grasped correctly.

SUMMARY OF THE INVENTION

The invention therefore provides for a bottle opener fixed to the fingers of the hand by a fixing device in such a way that serving staff server using a tray to serve a round of drinks indoors or out can open the bottles with just one hand. This can be accomplished without having (beforehand) to reach into a pocket for the bottle opener, and then carry out all the other operations involved in the opening function. In this way, the user is not significantly hampered by the bottle opener, which remains in place on his or her hand.

The invention also provides for a bottle opener that comprises a finger engaging portion adapted to at least partially surround at least one finger. A handle portion is fixed to the finger engaging portion. The handle portion includes an opening head. The opening head comprises a central opening. The central opening is defined by a bearing edge, a catching edge and two lateral sides. The handle portion has a surface that engages a user's palm when the bottle opener is used to open a bottle.

The finger engaging portion may comprise a ring. The finger engaging portion may comprise a split ring. The finger engaging portion may comprise two ring sector portions, whereby one ring sector portion is adapted to receive a user's index finger and whereby another ring sector is adapted to receive a user's middle finger.

The bottle opener may further comprise a connecting portion that connects the two ring sectors to the handle portion. The connecting portion may be adapted to fit between the user's middle and index fingers. The connecting portion may comprise a thickness and a width that is greater than the thickness. The connecting portion may have a width that is less than a width of the finger engaging portion. The finger engaging portion may comprise a split ring. The finger engaging portion may comprise two ring sector portions, whereby one ring sector portion is adapted to receive a user's index finger and whereby another ring sector is adapted to receive a user's middle finger. The connecting portion may comprise a deformable region.

The bearing edge may be rigid and roughly flat. The catching edge may be a rigid blade. The catching edge may comprise one of a straight edge and a slightly concave edge. The catching edge may be coupled to a surface that is arranged on a plane that is different from a plane of the handle portion that is connected to the finger engaging portion, whereby the planes are arranged parallel to one another. The two planes may be spaced apart from one another by an amount. The lateral sides may comprise guiding edges. The handle portion and the finger engaging portion may be made from steel. The handle portion and the finger engaging portion may be formed from a steel sheet that has been bent and welded. The handle portion may comprise steel and the finger engaging portion may comprise plastic. The finger engaging portion may be overmolded with plastic by injection molding.

The invention also provides for a method of opening a bottle using the bottle opener described above wherein the method comprises installing the finger engaging portion on at least one finger of a user, arranging the handle portion on an inside part of a user's hand so that the handle portion engages the palm of the hand, bending the user's fingers to grip a neck of the bottle, and opening the bottle with the opening head.

The invention also provides for a bottle opener comprising a finger engaging portion adapted to at least partially surround at least one finger. The finger engaging portion has an upper portion and a narrower lower portion. A metal handle portion is fixed to the finger engaging portion. The handle portion has a thickness, a width that is greater than the thickness, and an opening head. The opening head comprises a central opening that is disposed on an angled portion of the handle portion. The angled portion is arranged between two parallel surfaces of the handle portion. The central opening is defined by a bearing edge, a catching edge and two lateral sides. The handle portion has a surface that engages a user's palm when the bottle opener is used to open a bottle.

DETAILED DESCRIPTION OF THE INVENTION

Figure 1:
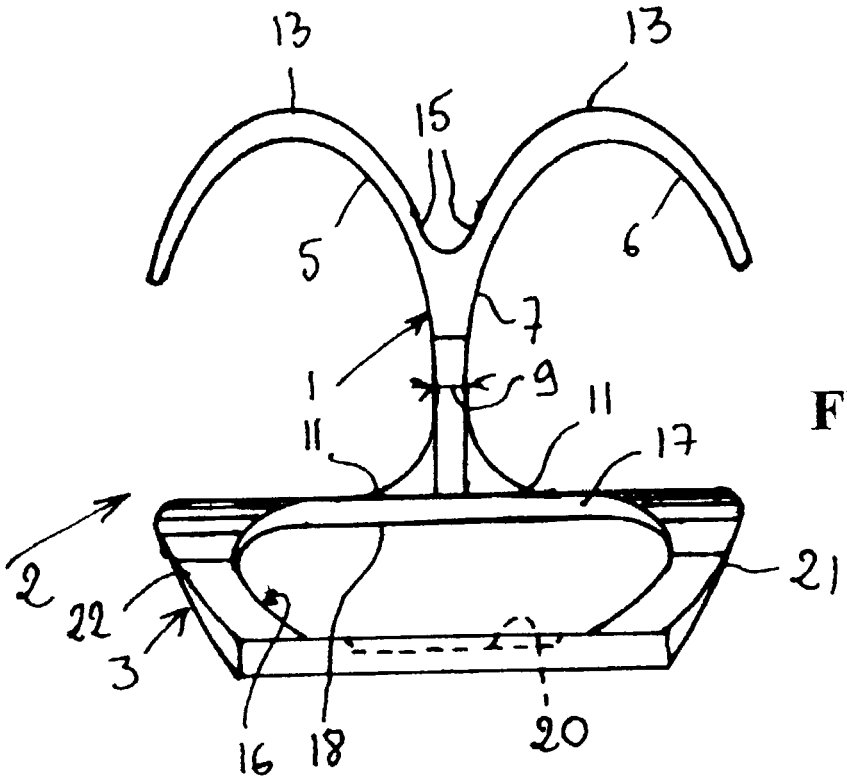
FIG. 1 is a view in elevation of the bottle opener.
Figure 2:
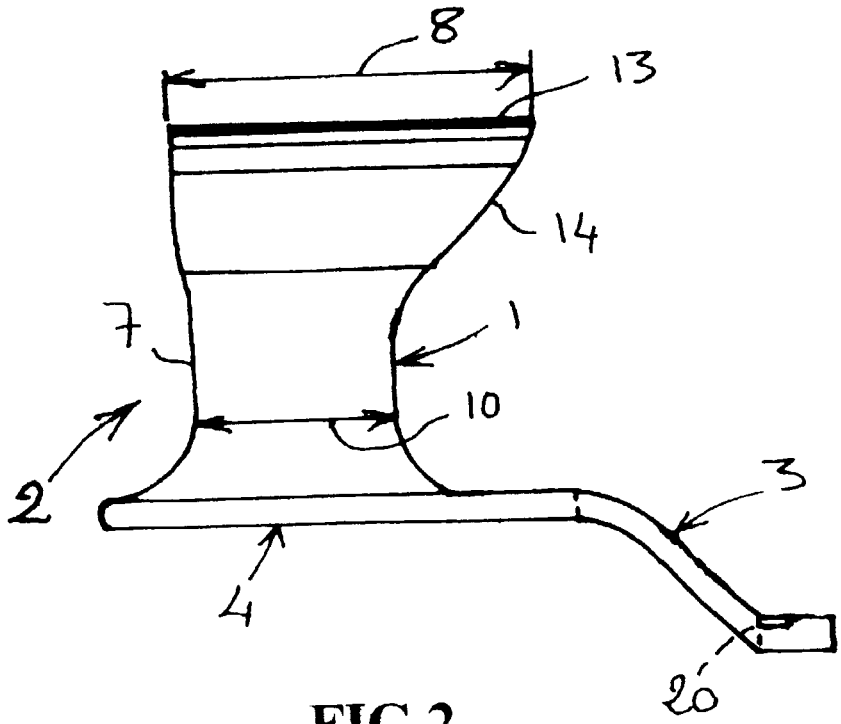
FIG. 2 is a side view thereof.
Figure 3:
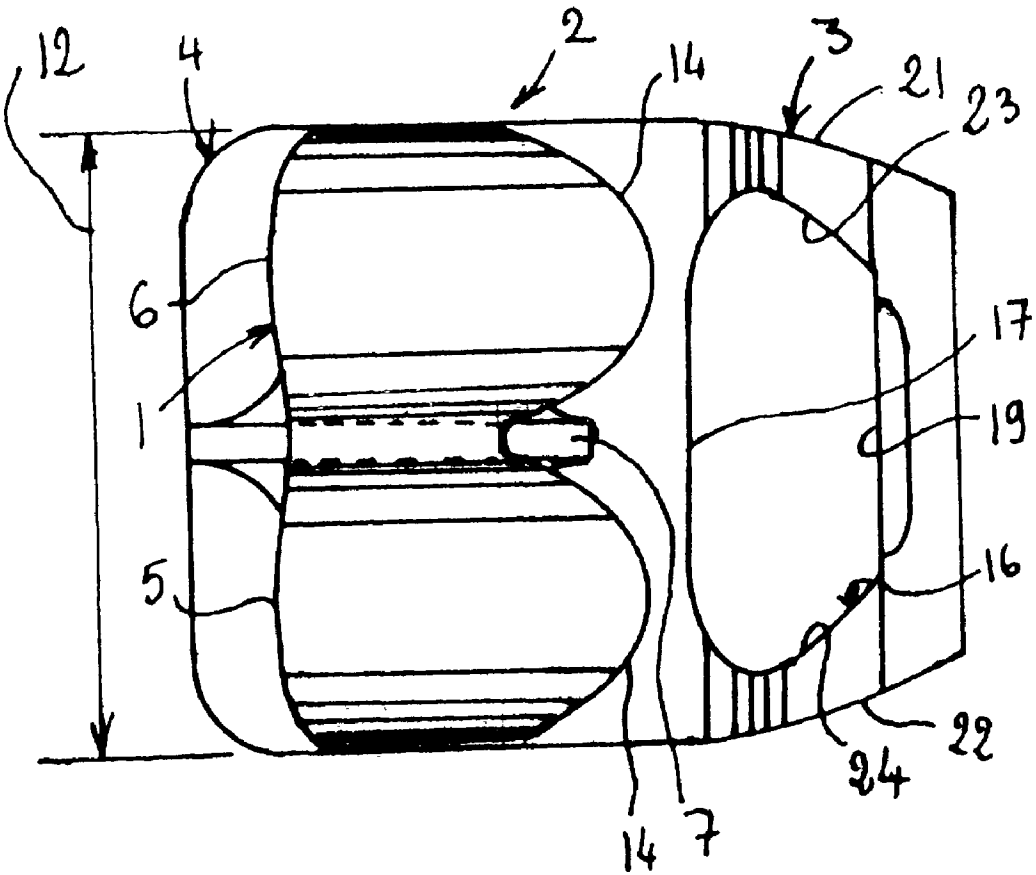
FIG. 3 is a plan view thereof from above.

According to the invention, the device 1 (FIGS. 1 to 3) for fixing the bottle opener 2 is placed, not at the level of the opening head 3, but at the level of the handle 4 so that the opening head 3 is placed in the palm of the hand while the handle 4, which is shortened. The fixing device 1 is arranged at the level of the first finger bones, i.e., of the index and the middle finger, where they are differentiated. When the fingers are in place in the fixing device 1, the opening head 3 is placed in the palm of the hand. The opening head 3 is thus placed at the base of the first finger bones where these are no longer-differentiated and are articulated to the metacarpal bones. In other words, it is arranged between the base of the index finger and of the middle finger and the transverse crease of the palm. Under these conditions, the palm of the hand can be folded and the opening head 3 can retract into this region of the palm of the hand which is fleshy and not hamper the movements of the hand.

In a preferred version of the invention, a first fixing device 1 may include two ring sectors 5 and 6 (FIG. 1) of variable width 8 (FIG. 2) placed back to back with a common part 7 being arranged in a central region. The device can thus be placed between the outside of the index finger and the inside of the middle finger (in the anatomic meaning of the term) and where these two fingers meet. The thickness 9 of this common part 7 is of the order of 1 to 2 millimeters so as to allow the index and middle finger to remain contiguous. Common Part 7 has a width 10 (FIG. 2) which may range from 5 to 10 millimeters. The common part 7 is arranged and shaped in such a way that it can be housed and wedged in an area where the two fingers meet. In this way, the middle and index finger can be moved apart without the fixing device 1 escaping therefrom. The lower part 11 of the ring sectors 5 and 6 is connected to the handle 4 which has a width 12 (FIG. 3) that is wide enough for the front part of the first finger bone of the index and of the middle finger to be able to press there without, however, hampering the movements of the ring finger and of the thumb. The upper part 13 of the ring sectors 5 and 6 comprises a widened region 14 on the side facing toward the articulation of the finger bones with the metacarpal bone. Correspondingly, the regions of connection 15 of the upper part 13 of the ring sectors 5 and 6 with their common part 7 have deformable regions 15. These allow the curvature of the ring sectors 5 and 6 to adapt to suit the fatness of the user's fingers.

The opening head 3 (FIG. 1) comprises a central cut-out 16 that includes a first side situated on the same side as the fingers, a second side situated facing the side of the crease line of the palm, and lateral sides connecting the first and the second side. The first side includes a bearing device 17 which allows the opening head 3 to bear against the upper part of the crown cork. The bearing device 17 is a rigid and roughly flat portion and is situated in the continuation of the handle 4 which constitutes a lever arm. It has a roughly straight bearing border 18 bordering the cut-out 16, of a length of the order of magnitude of a chord of a circle circumscribing the crinkle band situated at a distance, ranging from one quarter to one sixth of the length of the diameter, away from the center of the crinkle band. When the bearing device 17 is in place prior to the bottle opening operation, the bearing border 18 determines a line of pivoting of the lever arm consisting of the handle 4, positioned as described above with respect to the circle circumscribing the crinkle band. When the bearing device 17 is in place prior to bottle-opening, it is positioned in a plane which makes a small angle with the upper part of the crown cork. The second side comprises a catching device 19 (FIG. 3) which is a rigid blade. The central region of the blade is placed under the crinkles of the crinkle band when the bearing device 17 is in place on the top face of the crown cork as described above. This catching device 19 comprises a catching border 20 which is either straight or slightly concave and which lies in a plane parallel to the plane of the bearing device 17 and at a distance of the same order of magnitude as the height of the crown cork.

The first side and second side are connected by lateral sides 21 and 22 of which the parts bordering the cutout 16 preferably constitute guides 23 and 24 allowing the bearing 18 and catching 20 borders to be positioned correctly. Indeed, all that is required is for the handle 4 to be placed on the upper part of the crown cork with the common part 7 centered on the upper part of the crown cork and for the hand to be moved straight forward, bending the fingers to grip the neck of the bottle under the crown cork so that the bearing border 18 becomes positioned on the crown cork and the catching border 20 becomes positioned under the crinkle band. Next, the first finger bones of the index and middle finger press against the handle 4 via their front face, while the rear face of the first finger bones bear against the widened region 14 of the upper part 13 of the ring sectors 5 and 6 and allow the crown cork to be deformed thus uncrimping it.

Figure 4:
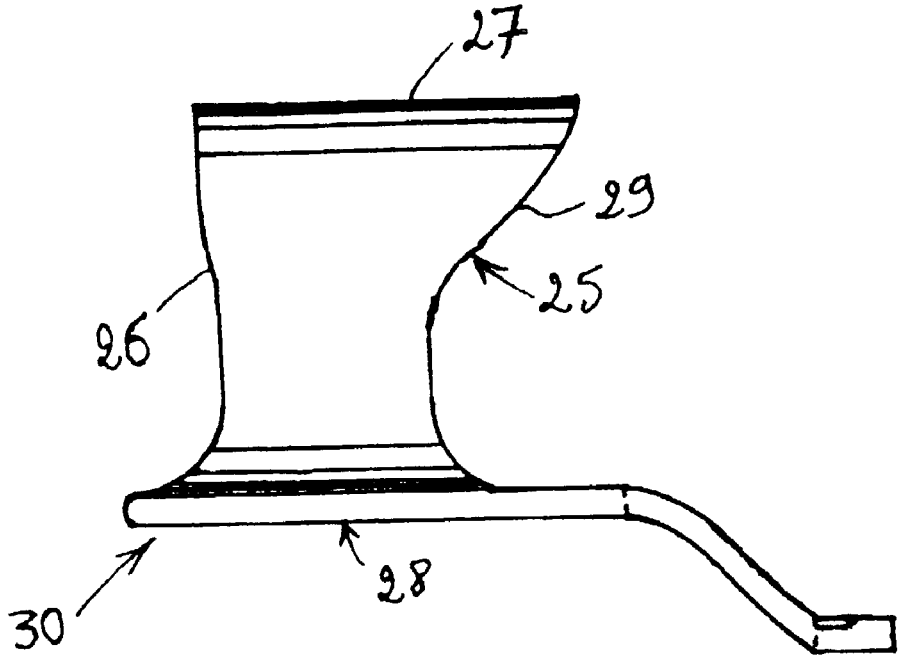
FIG. 4 is a view in elevation of an alternative form of embodiment of the bottle opener.
Figure 5:
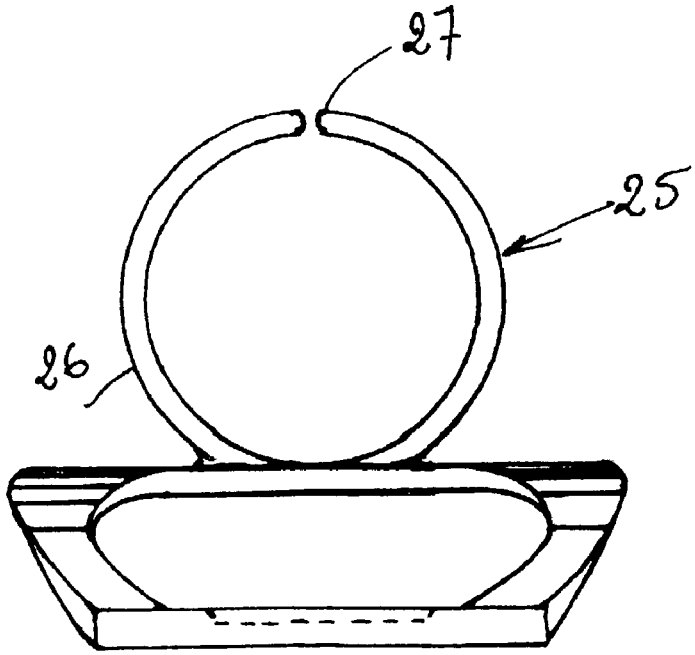
FIG. 5 is a side view thereof.

In an alternative embodiment of the invention, the first fixing device 1 (FIG. 1) is replaced by a second fixing device 25 (FIGS. 4 and 5) of the bottle opener 30 utilizing a ring 26 that is split at its upper part 27 fixed on the handle 28 and into which the middle or index finger of the hand is slipped. This ring has the same type of widened region 29 as those described for the upper part 13 (FIG. 2) of the ring sectors.

The fixing devices thus described can be made entirely of metal such as a stainless steel sheet that is 2 millimeters thick for example. The sheet can be pressed and spot-welded. In a preferred version, part of the handle 4, 28 and the opening head 3 are made of metal, while the fixing 30 device 1, 25 is made of injection-molded plastic which is preferably overmolded onto the handle 4, 28. In this way, the geometric characteristics can be modified to allow overmolding.

The invention claimed is:

1. A bottle opener comprising:

a ring-shaped finger engaging portion having an opening configured to receive a user's finger, a lower end, and a wider upper end;

a handle portion fixed to the lower end of the ring-shaped finger engaging portion;

the handle portion having a free end and an inclined angle portion arranged between the free end and the ring-shaped finger engaging portion;

the inclined angle portion being inclined at an angle relative to a center axis of the opening configured to receive a user's finger;

the inclined angle portion comprising a central opening defined by a bearing device, a catching device and two lateral sides;

the central opening being arranged between the ring-shaped finger engaging portion and the free end of the handle portion; and the bearing device being closer to the ring-shaped finger engaging portion than the catching device and the catching device being closer to the free end of the handle portion than the bearing device.

2. The bottle opener of claim 1, wherein the ring-shaped finger engaging portion and the handle portion comprise metal and the ring-shaped finger engaging portion is over-molded with the plastic by injection molding.

3. A bottle opener comprising:

a finger engaging portion configured to receive at least one finger;

a handle portion having a first end, a second end, a first side which is fixed to the finger engaging portion and a second side;

the handle portion further including an opening head;

the opening head being an inclined angle portion of the handle portion that is arranged between the first and the second ends and that extends from the second side to a spaced apart parallel third surface which extends to the second end;

the inclined angle portion having a central opening defined by a bearing device, a catching device and two lateral sides;

the bearing device being closer to the first end than the catching device and the catching device being closer to the second end than the bearing device, wherein the first side of the handle portion is structured and arranged to engage a user's palm when the bottle opener is used to open a bottle.

4. A method of removing a bottle cap comprising:

providing a bottle opener including a finger engaging portion configured to receive at least one finger, a handle portion having a first end, a second end, a first side which is fixed to the finger engaging portion and a second side, the handle portion further including an opening head, the opening head being an inclined angle portion of the handle portion that is arranged between the first and the second ends and that extends from the second side to a spaced apart parallel third surface which extends to the second end, the inclined angle portion having a central opening defined by a bearing device, a catching device and two lateral sides, the bearing device being closer to the first end than the catching device and the catching device being closer to the second end than the bearing device, wherein the first side of the handle portion is structured and arranged to engage a user's palm when the bottle opener is used to open a bottle;

positioning the finger engaging portion onto at least one finger;

engaging the bottle cap with the central opening of the opening head portion; and moving the handle portion to a position which removes the bottle cap from the bottle.

* * * * *